US005255848A

United States Patent [19]

Rhodehouse

[11] Patent Number: 5,255,848

[45] Date of Patent: Oct. 26, 1993

[54] MULTIPLE ORIFICE SPRAY DEVICE

[76] Inventor: Nolin C. Rhodehouse, 592 Reagan St., Idaho Falls, Id. 83401

[21] Appl. No.: 877,209

[22] Filed: May 1, 1992

[51] Int. Cl.[5] ..... B05B 15/02; B05B 1/04; B05B 1/16

[52] U.S. Cl. ..... 239/119; 239/288.3; 239/288.5; 239/436; 239/447; 239/597

[58] Field of Search ..... 239/119, 288, 288.3, 239/288.5, 436, 446, 447, 597, 599, 390, 393, 395

[56] References Cited

U.S. PATENT DOCUMENTS

| | | | |
|---|---|---|---|
| 2,140,903 | 12/1938 | Fisk | 299/138 |
| 3,088,679 | 5/1963 | Ford | 239/318 |
| 3,112,885 | 12/1963 | Bell et al. | 239/436 X |
| 3,116,882 | 1/1964 | Vork | 239/119 |
| 3,414,196 | 12/1968 | Legeza et al. | 239/106 |
| 3,831,862 | 8/1974 | Calder | 239/119 |
| 3,952,955 | 4/1976 | Clements | 239/288.5 |
| 4,437,610 | 3/1984 | Huber et al. | 239/119 |
| 4,635,850 | 1/1987 | Leisi | 239/288.3 |
| 4,830,281 | 5/1989 | Calder | 239/288.3 X |

FOREIGN PATENT DOCUMENTS

| | | | |
|---|---|---|---|
| 3239493 | 5/1983 | Fed. Rep. of Germany | 239/119 |

*Primary Examiner*—Andres Kashnikow
*Assistant Examiner*—William Grant
*Attorney, Agent, or Firm*—Hopkins, French, Crockett, Springer & Hoopes

[57] ABSTRACT

A multiple orifice spray nozzle having reversible orifice cleaning capability for use with high pressure liquid spraying systems. A first embodiment offers selection of a first or second orifice by vertical movement of an orifice selection cylinder. A second embodiment offers selection of a first or second orifice by rotation of the orifice selection cylinder about a vertical axis.

4 Claims, 6 Drawing Sheets

MULTIPLE ORIFICE SPRAY DEVICE

FIELD OF THE INVENTION

This invention relates to a multiple orifice spraying nozzle that can be used with a high-pressure liquid spray system, such as paint sprayers and the like.

BACKGROUND OF THE INVENTION

Airless, high-pressure spraying devices generally consist of a nozzle, guard, housing, self-cleaning rotatable turret having an orifice, and a pistol grip trigger to control the on-off spray The nozzle portion contains the turret having an orifice tip or metal insert with a small bore, typically in the range of 0.010 inches. The housing and guard can typically be formed from plastic. The guard functions to keep the high-pressure fluid spray from hitting any body parts at close range. Self-cleaning of the orifice is accomplished by 180° rotation of the turret, so that fluid flow is reversed to dislodge any particulates that may be clogging the orifice.

It is often necessary to change tips to provide for a heavier or finer spray pattern. The finer spray pattern is necessary for finish or detail work.

There are various means of cleaning and exchanging orifice sizes in the art. Exemplary are:

- U.S. Pat. No. 3,414,196 by Legeza discloses a self-cleaning spray gun tip having a vertical multiple-orifice slide that can be vertically removed, reversed, and reinserted in the spray gun to clean either of the clogged orifices.
- U.S. Pat. No. 3,088,679 by Ford discloses an aspirating sprayer having a multiple-orifice turret type selection device in a first embodiment. In a second embodiment, the orifice selection device is a linear slide. Third and fourth embodiments show a single orifice nozzle.
- U.S. Pat. No. 2,140,903 by Fisk discloses a low-pressure spraying nozzle that in a first embodiment issues a whirling spray through orifices and exits through an opening. Cleaning is performed by rotating a cylinder to cleaning positions. A second embodiment is shown having three selectable discharge orifices in the casing.

There are many other spray guns that include reversible tips that allow cleaning of the orifice, but none of the above have a simple vertically oriented cylinder having more than one orifice and can be also easily rotated for cleaning.

It is the purpose of this invention to provide a simpler, multi-orifice spray tip having the reversible orifice cleaning capability and an open-faced, non-drip tip guard. This invention allows the user to change spray tip sizes without going through the process of changing orifice tip holders, in this case, the vertical cylinder or turret.

SUMMARY OF THE INVENTION

This invention discloses a novel—yet simple—airless, high-pressure, liquid spray device having two selectable orifices that has the added capability of reversing the orifices to provide a self-cleaning function. In a first embodiment, the spray device attaches on the front of a pistol grip of an on-off trigger which receives paint or other liquid from a high-pressure compressor. It is the purpose of the spray device to select either a fine pattern spray or, by 15 movement of an orifice selection cylinder, to select a coarse or bigger pattern spray. The first embodiment selection cylinder has two orifices, one above the other, and selection is by a linear vertical motion to an upper or lower spray operating position. Vertical motion can be limited by a shoulder on the cylinder that engages a top housing portion and a collar on the bottom of the cylinder that engages a bottom portion of the housing. Rotation of the cylinder can be limited to a preferred 180° arc by appropriate tabs on the cylinder and collar that engage the housing at the 180° limit of travel: the first rotary position being a spray position and the second being a cleaning position at 180°. It is also possible to remove the cylinder from the housing by removing a fastener holding the collar to the cylinder.

Orientation of the rectangular spray pattern is controlled by the orientation of an orifice insert that can have a slot in a vertical or horizontal position within the cylinder. If a vertical slot orientation is chosen, the resulting spray pattern is taller than it is wide on the paint surface. This configuration requires a slot in the top and bottom of the spray guard, normally not provided on spray guns. Conversely, if the horizontal slot orientation is used, the resulting spray pattern will be wider than it is tall.

In a second embodiment, a spray orifice selection cylinder within the housing selects between orifices by rotation about a vertical axis. In this case, the cylinder is free to rotate 360°, i.e., 0° for fine spray, 90° for coarse spray, 180° to clean the fine spray orifice, and 270° to clean the coarse spray orifice. In this case, the cylinder may easily be removed by releasing the paint spray trigger and pulling the cylinder out vertically. Boring the cylinder to provide inlet and outlet orifice locations at the same elevation on the cylinder is accomplished by angling the inlet and outlet portions of the bore apertures. Selection of orifices can be identified by appropriate shapes of the operating handle on the top of the cylinder.

Other objects, advantages, and capabilities of the present invention will become more apparent as the description proceeds.

DETAILED DESCRIPTION OF THE INVENTION

Figure 2:
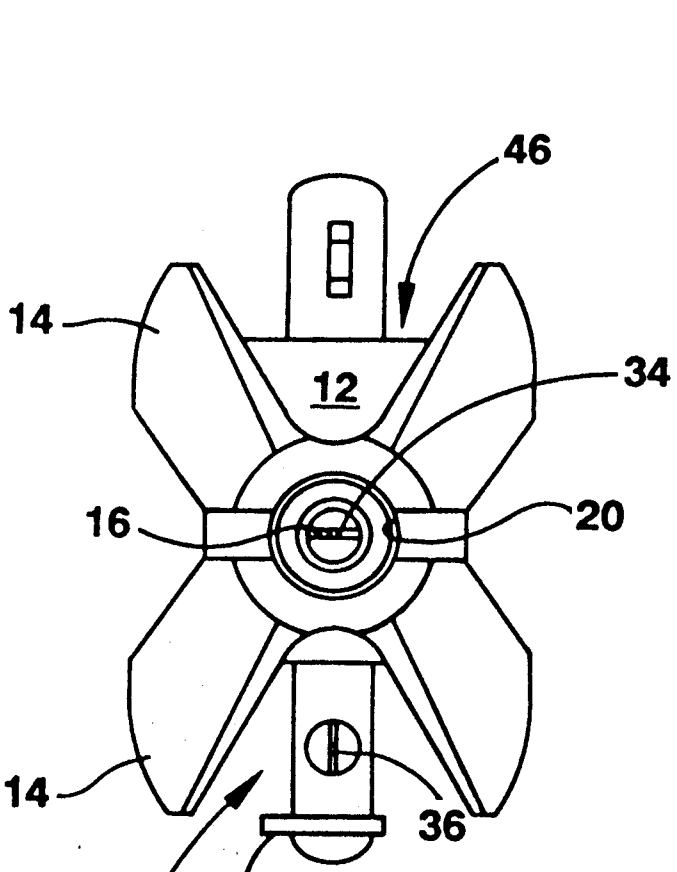
FIG. 2 is a front elevation of the spray device.
Figure 1:
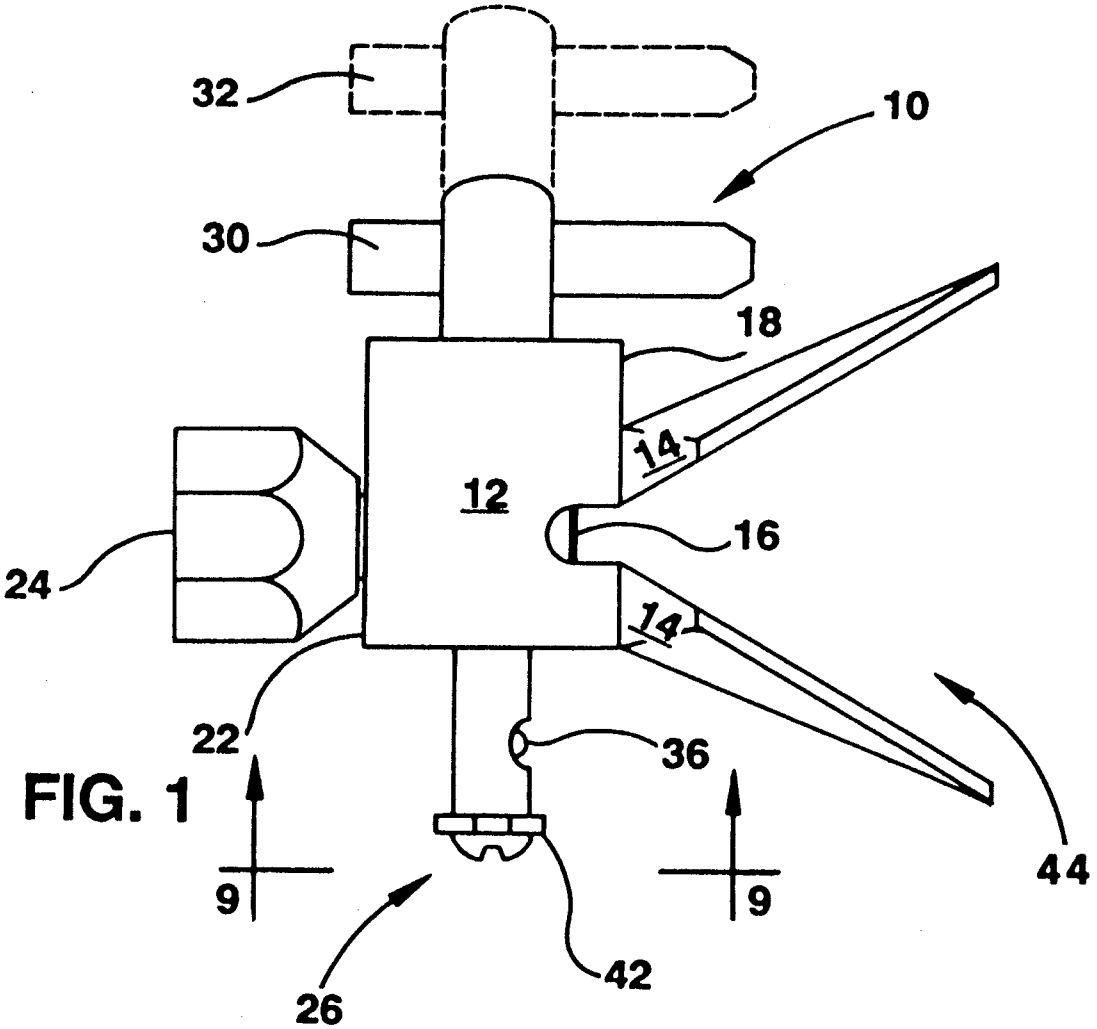
FIG. 1 is a side elevation of a multiple orifice spray device.
Figure 3:
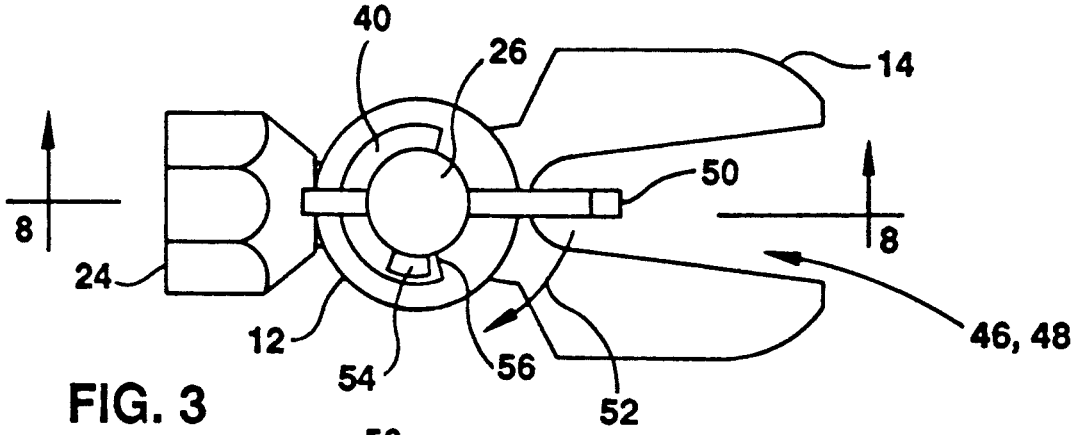
FIG. 3 is a top view of the spray device.
Figure 4:
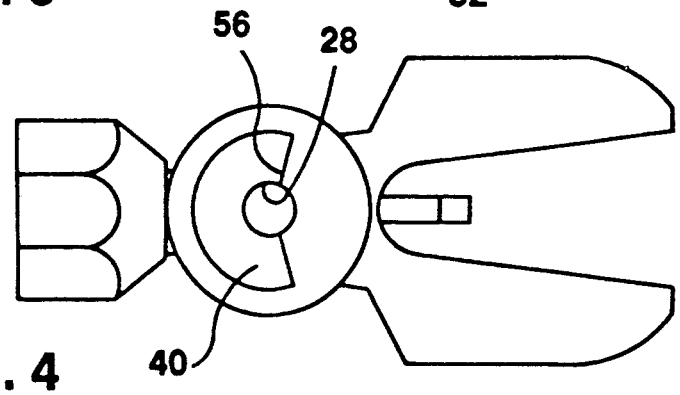
FIG. 4 is a top view of the housing without an orifice selection cylinder.
Figure 7:
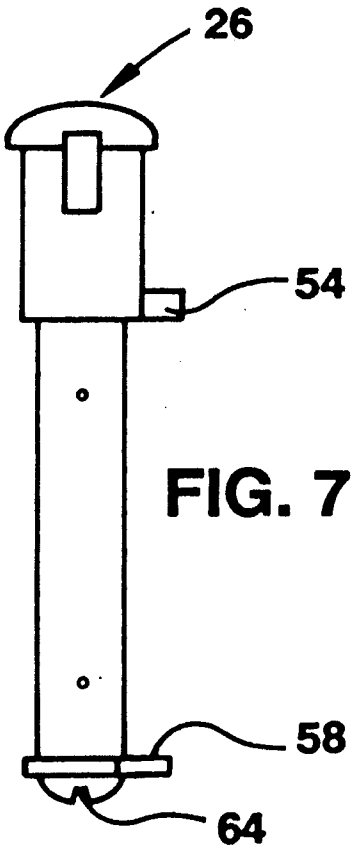
FIG. 7 is an opposite side elevation of the orifice selection cylinder.
Figure 6:
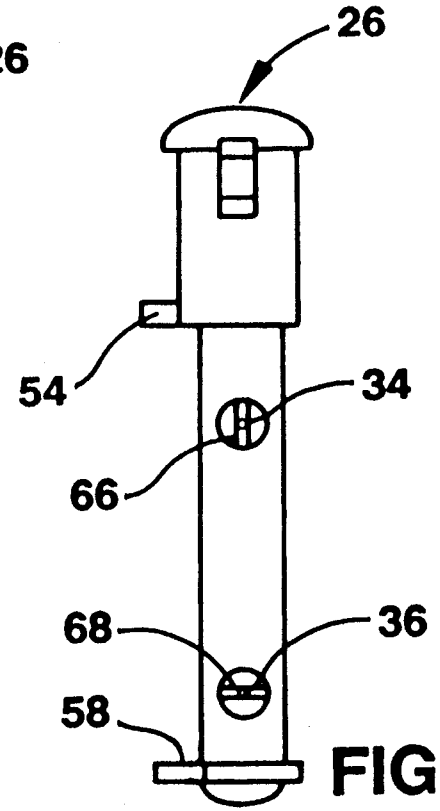
FIG. 6 is a front elevation of the orifice selection cylinder.

A description of the inventive spray device 10 can be seen at FIGS. 1, 2, and 3. Housing 12 has a spray guard 14 and nozzle 16 on a front section 18. The nozzle 16 is within a horizontal bore 20 of the housing 12. The back section 22 of the housing 12 has a liquid inlet and hose connection 24. The hose connection typically connects to a pistol grip handle and trigger controlling the on-off function. An orifice selection cylinder generally illustrated at 26 is slidably fitted within the vertical bore 28 (FIG. 4) of housing 12. FIG. 1 illustrates the orifice selection cylinder 26 in a first operating position at 30 and a second operating position 32 (in phantom). Selection of the first or second operating position is accomplished by moving the selection cylinder 26 vertically to select a first or second orifice 34, 36 (FIG. 2). For instance, orifice 34 can be a small orifice for fine spraying and second orifice 36 can be a larger orifice for larger volume spraying. Vertical downward motion of orifice selection cylinder 26 is restrained by a shoulder 38 (FIG. 5) bearing on a housing recess 40 and upward motion is restrained by collar 42 at a base of the selection cylinder 26.

Typical prior art spray guards 14 have openings as at 44 to allow a horizontally oriented, rectangular spray pattern. In this invention, there is an addition slot in an upper and lower portion of the spray guard as at 46 and 48, thereby allowing a vertically oriented, rectangular spray pattern as an option.

A feature of the instant device is an orifice self-cleaning capability where 180° rotation of handle 50 as at arrow 52 (FIG. 3) reverses the orifice thereby clearing an orifice inlet portion of any particulate that may be in the fluid.

Figure 5:
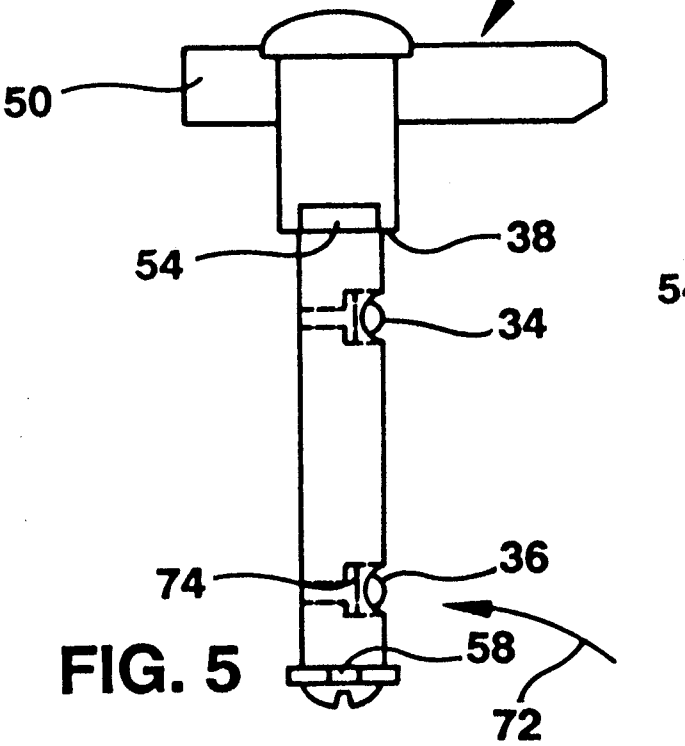
FIG. 5 is a side elevation of the orifice selection cylinder.
Figure 9:
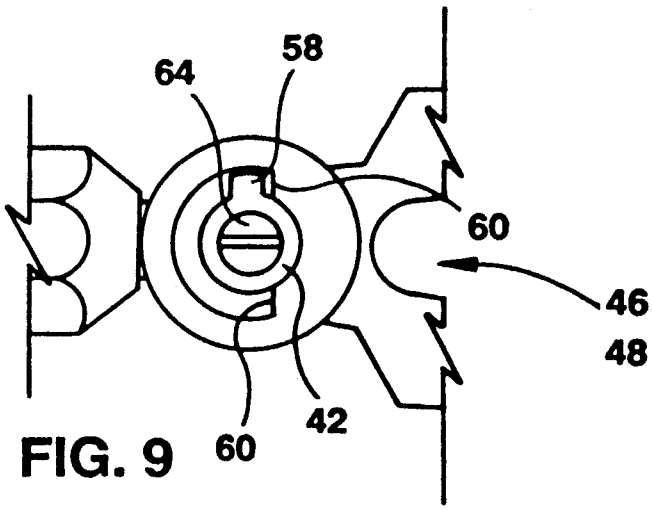
FIG. 9 is a bottom section view taken through lines 9—9 of FIG. 1.
Figure 8:
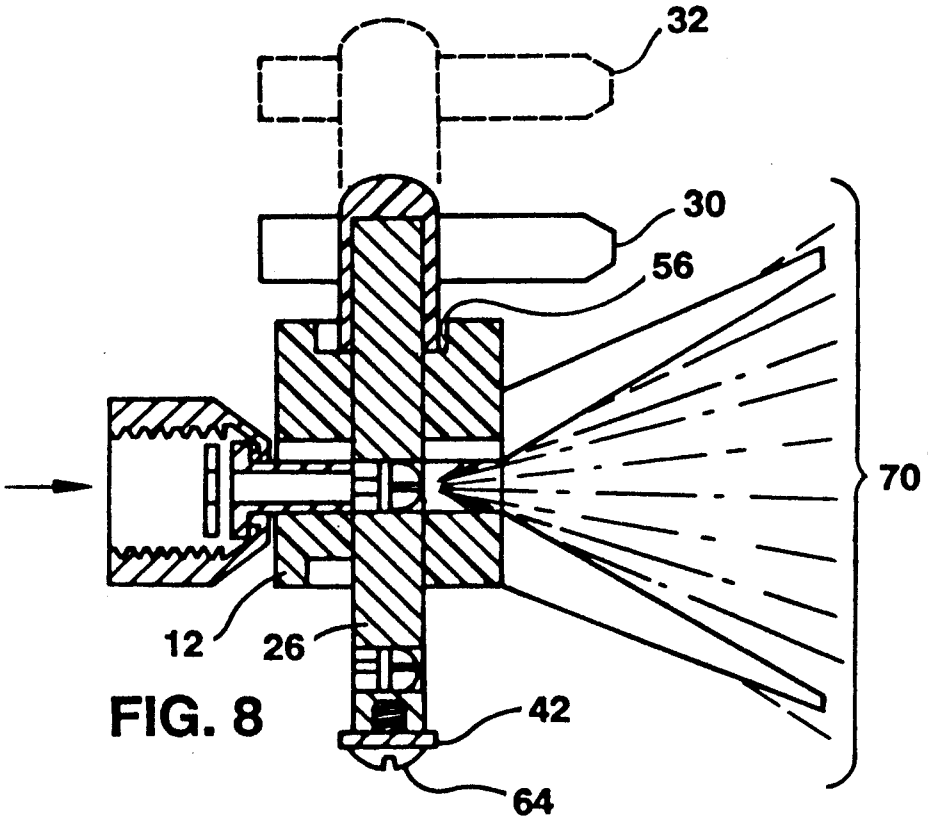
FIG. 8 is a side section view taken through lines 8—8 of FIG. 3.
Figure 10:
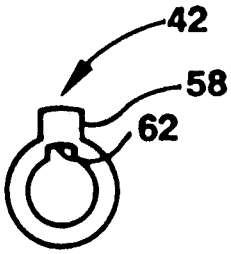
FIG. 10 is a plan view of a collar.

Referring to FIGS. 4–8, it can be seen that rotation of cylinder 26 for cleaning purposes is limited to 180° rotation in the first operating position by shoulder tab 54 (FIGS. 3, 5, 6, and 7) engaging an upper stop portion 56 of the housing 12 (FIGS. 3 and 8). In the upper or second operating position 32 (FIG. 8), a collar tab 58 limits rotation of cylinder 26 by engaging a lower stop portion 60 as indicated in bottom view of FIG. 9. The details of collar 42 with tab 58 are illustrated in FIG. 10 which also shows keyway 62 that properly orients the collar tab 58 with shoulder tab 54 both being 90° from the cylinder orifices 34 and 36 (FIG. 5). Removal of fastener 64 and collar 42 (FIG. 8) allows vertical removal of the cylinder 26 from housing 12 for cleaning or replacement.

Referring again to FIG. 6, the two orifice orientations can be seen at 34 and 36. The first orifice 34 terminates at a vertical slot 66 and the second orifice terminates in a horizontal slot 68. The first orifice would project a vertically oriented, rectangular spray pattern as at 70 (FIG. 8), which demonstrates the need for upper and lower portion openings 46 and 48 within spray guard 14 (FIGS. 2 and 9). Conversely, in the second spray operating position 32 (FIG. 8), the second (or lower) orifice 36 having the horizontal slot, the spray pattern would be of a horizontally oriented, rectangular spray pattern.

In this configuration, the first orifice could have a diameter of about 0.014 inches for a finer spray, and the second orifice for high volume and horizontal spray pattern could have a diameter of about 0.019 inches. It is also possible to orient both spray slots parallel, as an option, so as to provide similarly oriented rectangular spray patterns.

In the cleaning mode, liquid flow is in the direction of arrow 72 (FIG. 5) which tends to clear an orifice inlet portion 74 of any solid particulates.

Figure 11:
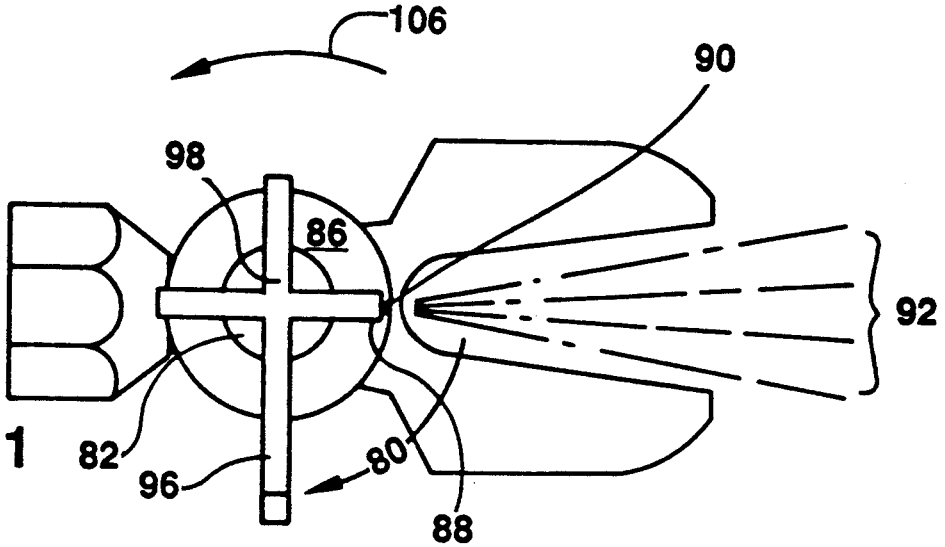
FIG. 11 is a top view of a second embodiment of the spray device.
Figure 12:
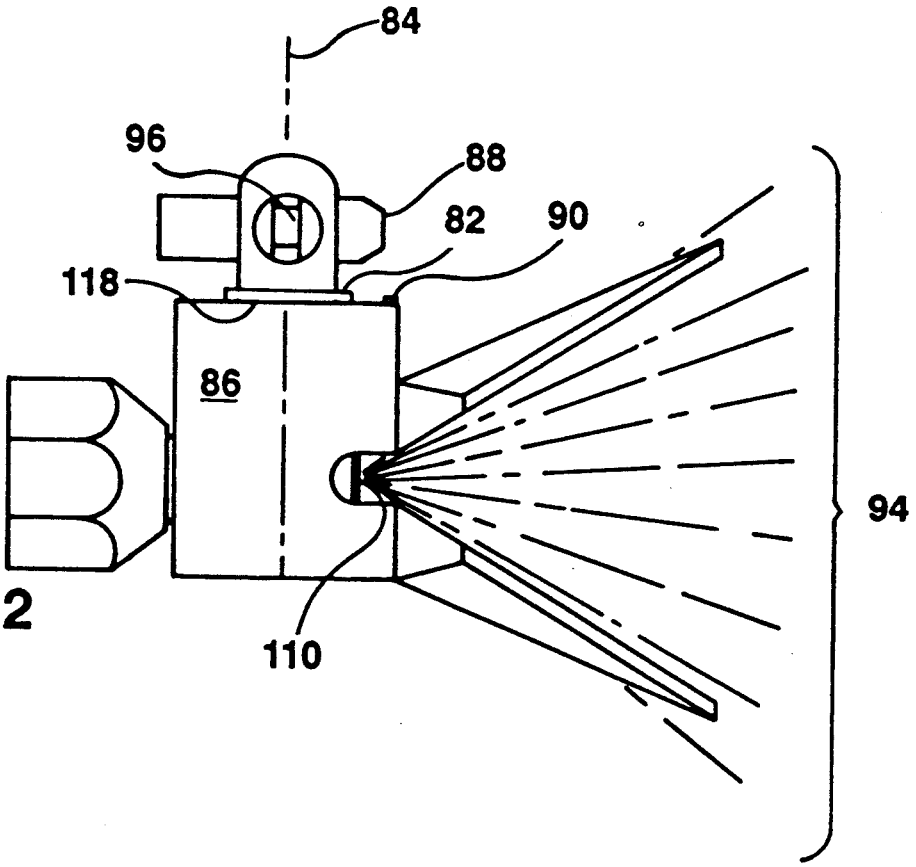
FIG. 12 is a side elevation of the second embodiment of the spray device.

A second spray device 80 is disclosed in FIGS. 11–16. In this device, selection of a first and second spray orifice is by 90° rotation of the spray selection cylinder 82 about the cylinder axis 84, within housing 86. In FIGS. 11 and 12, the first orifice has been selected as indicated by the short arrow handle section 88 being adjacent raised marker arrow 90. In this configuration, the vertically oriented spray pattern is generated as indicated by the width 92 and length 94 of the spray pattern.

Selection of the second orifice is accomplished by aligning the long arrow handle section 96 adjacent the marker arrow 90. As can be seen, the orifice selection is by 90° rotation of handle 98.

Figure 13:
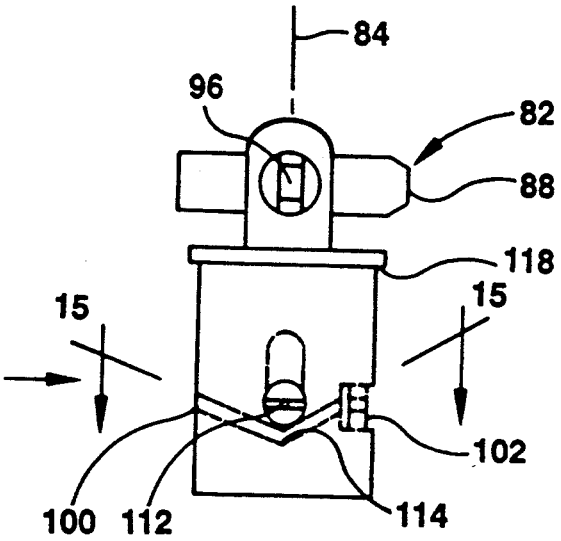
FIG. 13 is a side elevation of a second embodiment of the orifice selection cylinder.

The details of the rotary selection cylinder 82 can be seen in FIGS. 13–16. In FIG. 13, fluid enters the cylinder at orifice inlet portion 100 and exits at an orifice insert 102 for handle 98 orientation as shown in FIGS. 11 and 12. The insert 102 in this case Would have a vertical slot 104 (FIG. 15) for the vertically oriented spray pattern.

Figure 14:
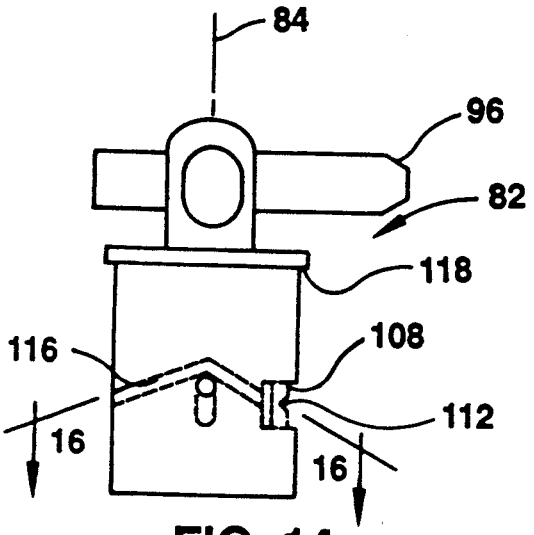
FIG. 14 is a front elevation of a second embodiment of the orifice selection cylinder.
Figure 15:
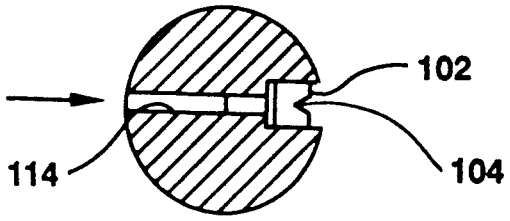
FIG. 15 is a top section view taken through lines 15—15 of FIG. 13.
Figure 16:
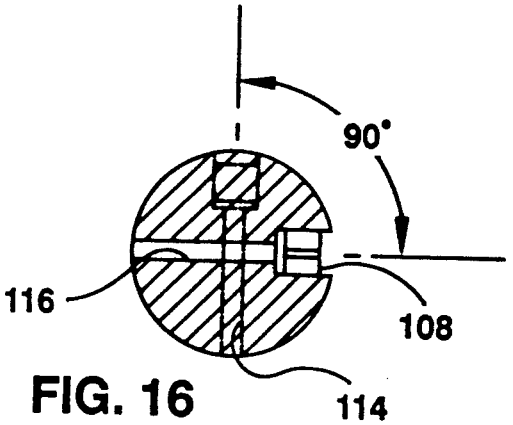
FIG. 16 is a top section view taken through lines 16—16 of FIG. 14.

Rotation of handle 98 for 90° as at arrow 106 (FIG. 11) would align the second orifice insert 108 (FIGS. 14 and 16) with the nozzle outlet 110 (FIG. 12). FIGS. 14 and 16 illustrate a side and section view after 90° rotation of the cylinder 82. In this case, the orifice slot 112 is horizontal providing a horizontally oriented spray pattern.

The cleaning positions for each of these orifice inserts 102 and 108 are 180° from the spray operating position. The orifice bores for each orifice are shown at 114 and 116 of section views of FIGS. 15 and 16. These bores 114 and 116 are angled to avoid intersection bores within the cylinder as seen by phantom lines of FIGS. 13 and 14.

In this second embodiment, there is no need for a rotational stop since the cylinder 82 can be rotated 360°. Additionally, there is no need for the bottom collar to prevent upward motion. The cylinder can be easily removed vertically up, and down alignment is obtained by shoulder 118 (FIGS. 12–14) engaging housing 86.

Although this second embodiment describes a rotation selection cylinder having two orifices, it is also possible to have additional orifices, e.g., three orifices at 120° for fine, medium, and coarse spray control.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. A multiple orifice high pressure liquid spray device comprising:

a. a housing having a front section, a back section, a vertical bore, and a horizontal bore;

b. a spray guard and nozzle on the front section of the housing adjacent a horizontal bore front section said spray guard further comprising an upper and lower portion each having a slot, thereby permitting a vertically oriented, rectangular spray pattern;

c. a liquid inlet and hose connection on the back section of the housing adjacent a horizontal bore back section;

d. an orifice selection cylinder slidably fitted within the vertical housing bore, having a first and second spray operating position, wherein at least one of said first and second spray operating positions disperses vertically oriented, rectangular spray pattern;

e. a first and second orifice within the orifice selection cylinder wherein the first orifice is on an upper section of the orifice selection cylinder adjacent the nozzle in the first spray operating position and the second orifice is on a lower section of the orifice selection cylinder in a non-operating position, whereby sliding the orifice selection cylinder upward to the second spray operating position aligns the second orifice adjacent the nozzle, and wherein 180° rotation of the orifice selection cylinder within the housing bore from each spray operating position about a vertical cylinder axis, causes reverse flow through the orifice thereby clearing an orifice inlet portion of a particulate.

2. The spray device as recited in claim 1 wherein the first spray operating position disperses a vertically oriented, rectangular spray pattern, and the second spray operating position disperses a horizontally oriented, rectangular spray pattern.

3. The spray device as recited in claim 1 wherein an upward motion of the selection cylinder is stopped by a collar on the selection cylinder and a downward motion the selection cylinder is stopped by a shoulder on the selection cylinder.

4. The spray device as recited in claim 3 wherein 180° rotation of the orifice selection cylinder in the first spray operating position is stopped by a shoulder tab on the selection cylinder engaging an upper stop portion of the housing, and 180° rotation of the orifice selection cylinder in the second spray operating position is stopped by a collar tab engaging a lower stop portion of the housing.

* * * * *